US008796924B2

(12) United States Patent
Behr et al.

(10) Patent No.: US 8,796,924 B2
(45) Date of Patent: Aug. 5, 2014

(54) HALOGEN INCANDESCENT LAMP FOR A VEHICLE HEADLIGHT

(75) Inventors: Gerhard Behr, Altheim (DE); Peter Helbig, Sontheim/Brenz (DE); Christian Seichter, Herbrechtingen (DE)

(73) Assignee: OSRAM AG, Munich (DE)

( * ) Notice: Subject to any disclaimer, the term of this patent is extended or adjusted under 35 U.S.C. 154(b) by 0 days.

(21) Appl. No.: 13/583,250

(22) PCT Filed: Feb. 23, 2011

(86) PCT No.: PCT/EP2011/052668

§ 371 (c)(1),
(2), (4) Date: Sep. 28, 2012

(87) PCT Pub. No.: WO2011/110425

PCT Pub. Date: Sep. 15, 2011

(65) Prior Publication Data

US 2014/0184060 A1 Jul. 3, 2014

(30) Foreign Application Priority Data

Mar. 8, 2010 (DE) ..... 10 2010 002 650

(51) Int. Cl.
*H01K 1/46* (2006.01)

(52) U.S. Cl.
USPC ..... 313/579; 313/636; 313/578; 313/318.01; 313/318.09

(58) Field of Classification Search
None
See application file for complete search history.

(56) References Cited

U.S. PATENT DOCUMENTS

| | | | | |
|---|---|---|---|---|
| 4,769,574 | A * | 9/1988 | Nagasawa et al. | 313/318.09 |
| 5,010,272 | A | 4/1991 | Eckhardt et al. | |
| 5,339,002 | A | 8/1994 | Braun et al. | |
| 5,957,569 | A | 9/1999 | Helbig et al. | |
| 2004/0240228 | A1 * | 12/2004 | Behr et al. | 362/549 |
| 2005/0041420 | A1 | 2/2005 | Tiesler-Wittig et al. | |
| 2006/0043898 | A1 | 3/2006 | Auer et al. | |

FOREIGN PATENT DOCUMENTS

| | | | |
|---|---|---|---|
| CA | 2194288 | C | 2/1996 |
| CA | 2642923 | A1 | 8/2007 |
| DE | 2246333 | A1 | 3/1974 |
| DE | 9017224 | U1 | 3/1991 |
| DE | 10148115 | A1 | 4/2003 |
| DE | 10200831 | A1 | 7/2003 |
| EP | 0384240 | A2 | 8/1990 |

(Continued)

OTHER PUBLICATIONS

English Machine Translation of the Specification of DE 2246333 A1. Mar. 28, 1974.

(Continued)

*Primary Examiner* — Ashok Patel

(57) ABSTRACT

An incandescent halogen lamp for vehicle headlights may include a lamp base which defines a reference plane for orienting the incandescent halogen lamp in the vehicle headlight and includes a holder part having a substantially rotationally symmetrical external contour for holding a translucent lamp vessel, with the holder part having a first holder-part section connected to a component of the lamp base and a second holder-part section from which the translucent lamp vessel projects, wherein the second holder-part section has a smaller external diameter than the first holder-part section and wherein the height of the lamp base above the reference plane is in the 11.5-to-16.6-mm range.

8 Claims, 5 Drawing Sheets

(56) References Cited

FOREIGN PATENT DOCUMENTS

| | | | |
|---|---|---|---|
| JP | 2006066393 | A | 3/2006 |
| WO | 9605610 | A1 | 2/1996 |
| WO | 9725733 | A1 | 7/1997 |
| WO | 2007096330 | A1 | 8/2007 |

OTHER PUBLICATIONS

United Nations, E/ECE324, E/ECE/Trans/505, Rev.1/Add.26/Rev.4, Uniform Provisions Concerning the Approval of Filament Lamps for Use in Approved Lamp Units on Power-Driven Vehicles and of their Trailers, Oct. 26, 2005.

* cited by examiner

HALOGEN INCANDESCENT LAMP FOR A VEHICLE HEADLIGHT

RELATED APPLICATIONS

The present application is a national stage entry according to 35 U.S.C. §371 of PCT application No.: PCT/EP2011/052668 filed on Feb. 23, 2011, which claims priority from German application No.: 10 2010 002 650.6 filed on Mar. 8, 2010.

TECHNICAL FIELD

Various embodiments relate to an incandescent halogen lamp.

BACKGROUND

An incandescent halogen lamp of such kind is disclosed in, for example, WO 96/05610 A1. That publication of an unexamined application describes an incandescent halogen lamp for vehicle headlights having a lamp base which defines a reference plane for orienting the incandescent halogen lamp in the vehicle headlight and includes a cylindrical holder part in which a lamp vessel is fixed into position. The lamp vessel of the incandescent halogen lamp has a rotationally symmetrical vessel section that encloses filaments and a dipping cap and which is closed at one end by a lamp-vessel dome and at the other by a lamp-vessel seal. The lamp-vessel seal is fixed into position in the holder part and has electrical supply leads projecting from it for the filaments.

Regulation 37 of the ECE standard specifies a maximum lamp outline for category H7, H8, and H16 incandescent halogen lamps. In particular the lamp's extent L1 in the longitudinal direction from the lamp base's reference plane oriented perpendicularly thereto as far as the lamp-vessel dome must not exceed 44.0 mm. That means the condition L1<44.0 mm must have been met. According to ECE regulation 37 a metal-free zone must furthermore have been ensured in the case of category H7, H8, and H16 incandescent halogen lamps to prevent any disturbance due to scattered light and mirror images in the vehicle headlight. Said metal-free zone is defined schematically in FIG. 4 by straight line G and winding axis A of the coiled filament. Straight line G intersects axis A of the coiled filament 3.0 mm below the first coil of coiled filament 3 at an angle of 40 degrees or, as the case may be, 140 degrees. Angle $\alpha$ between straight line G and horizontal line F extending perpendicularly to coiled-filament axis A (FIG. 4) is hence 50 degrees. According to regulation 37 of the ECE standard, in the case of category H7, H8, and H16 incandescent halogen lamps, except for filament coils there must not be any metal parts in the region inside lamp vessel 1 situated above straight line G and to the right of coiled-filament axis A when the lamp is oriented as selected in FIG. 4. For the aforementioned categories of incandescent halogen lamps it is furthermore specified by regulation 37 of the ECE standard that distance E between the coiled filament and reference plane R defined by the lamp base be in the range of 25.0 mm±0.1 mm. The value for the lamp base's height B above reference plane R is in the 9-to-1'-mm range in the case of incandescent halogen lamps according to the prior art.

SUMMARY

Various embodiments provide a generic incandescent halogen lamp for vehicle headlights that exhibits greater stability in the presence of vibrations.

The inventive incandescent halogen lamp has a lamp base which defines a reference plane for orienting the incandescent halogen lamp in the vehicle headlight and includes a holder part having a substantially rotationally symmetrical external contour for holding a translucent lamp vessel, with the holder part having a first holder-part section connected to a component of the lamp base and a second holder-part section from which the translucent lamp vessel projects. The second holder-part section inventively has a smaller external diameter than the first holder-part section and the lamp base's height above the reference plane is inventively in the 11.5-to-16.6-mm range. The latter means that the height of the lamp-base section situated between the reference plane and the section of the lamp vessel projecting from the lamp base is in the 11.5-to-16.6-mm range.

The inventive incandescent halogen lamp can as a result be fitted with a lamp vessel that has been shortened compared with the prior art and the distance of 25 mm±0.1 mm specified by regulation 37 of the ECE standard between the at least one filament and the reference plane can additionally be ensured. The lamp-vessel mount's vibration resistance will be increased owing to the shortened lamp vessel fixed into position in the holder part preferably by means of its lamp-vessel seal. The inventive incandescent halogen lamp can as a result furthermore have shortened electrical supply leads for the at least one filament. That means the sections of the electrical supply leads extending inside the lamp vessel that are connected to the at least one filament can be embodied likewise as being shorter than in incandescent halogen lamps according to the prior art. In the case of inventive incandescent halogen lamps the sections of the electrical supply leads extending inside the lamp vessel for the filament can in particular be approximately 30% to 40% shorter than in incandescent halogen lamps according to the prior art. The inventive incandescent halogen lamps will hence additionally also have a filament mount that exhibits increased vibration resistance. The smaller external diameter of the second holder-part section of the holder part for the lamp vessel will ensure that the inventive incandescent halogen lamps have the above-described metal-free zone specified by ECE regulation 37.

The smaller external diameter of the second holder-part section can be realized in various ways for ensuring the aforementioned metal-free zone. According to a first preferred exemplary embodiment of the invention the first and second holder-part section are each embodied cylindrically, with the second holder-part section from which the lamp vessel projects having a smaller external diameter than the first holder-part section which is connected to a component of the lamp base. That means the holder part has an external diameter reduced in a stepped manner along its axis of rotation in the direction of the side from which the lamp vessel projects. According to a second preferred exemplary embodiment of the invention the second holder-part section from which the lamp vessel projects is embodied in the manner of a truncated cone and the first holder-part section which is connected to a component of the lamp base is embodied as being cylindrical. That means the holder part is embodied as conically tapering along its axis of rotation in the direction of the side from which the lamp vessel projects. The first holder-part section can alternatively also be embodied in the manner of a truncated cone and the second holder-part section as being cylindrical.

As a further alternative it is possible also for the first and second holder-part section to be embodied in the manner of a truncated cone.

In other words, in order to ensure the metal-free zone specified by ECE regulation 37 the holder part is in all variants of the inventive incandescent halogen lamp embodied such that its external diameter is reduced in a stepped manner or in the manner of a truncated cone along the holder part's axis of rotation in the direction of the side from which the lamp vessel projects. In all the aforementioned variants the inventive incandescent halogen lamp's holder part can in a simple manner be connected to a component of the lamp base, in particular to a cylindrical metal sleeve.

The height of the inventive incandescent halogen lamp's base above the lamp base's reference plane is preferably in the 12-to-16.6-mm range and particularly preferably in the 13-to-16-mm range. Even with a conical holder part, the condition as regards the metal-free zone could no longer be met were the lamp base's height more than 16.6 mm above the reference plane, and no appreciable improvement could be achieved in the incandescent halogen lamp's vibration resistance were the lamp base's height less than 11.5 mm above the reference plane.

The height of the second holder-part section is preferably in the 3-to-6-mm range in order to achieve an increase in the lamp base's height above the reference plane in as simple a manner as possible while at the same time enabling the other components of the inventive incandescent halogen lamp's base to be adopted unchanged from the lamp base of the incandescent halogen lamp according to the prior art.

The inventive incandescent halogen lamp's at least one filament is for production reasons preferably surrounded by a cylindrical lamp-vessel section closed at one end by means of a lamp-vessel seal out of which electrical supply leads for the at least one filament are led and at the other end by means of a lamp-vessel dome.

The length of the cylindrical lamp-vessel section is preferably less than or equal to 18 mm so that an as short as possible lamp vessel will on the one hand make it possible to ensure a high degree of vibration resistance for the lamp and, on the other, make a correspondingly small lamp-vessel volume possible so that only a small amount of inert gas such as, for example, xenon or krypton will be needed for filling the lamp vessel.

The external diameter of the inventive incandescent halogen lamp's cylindrical lamp-vessel section is preferably in the 9-to-10-mm range.

It is thereby possible likewise to match the lamp vessel's volume, the filament's distance from the lamp vessel, and the amount of filling gas for the halogen circulating process to the inventive incandescent halogen lamp's electric power consumption. Owing to their lamp vessel's small dimensions the inventive incandescent halogen lamps will in particular require a smaller amount of inert gas such as xenon or krypton, for example, so that costs can be saved as a result.

The lamp vessel of the inventive incandescent halogen lamp is made preferably of tempered glass, for example alkali-free alkaline earth aluminosilicate glass. That means that a molybdenum foil seal will not be required for the electrical supply leads and the electrical supply leads for the at least one filament can in a gas-tight manner be led through to the outside directly across the lamp-vessel seal as wires, which will in turn make lamp vessels possible having very small dimensions.

In the inventive incandescent halogen lamps the filament's distance from the reference plane is in the range of 25.0 mm±0.1 mm in the case of category H7, H8, and H16 incandescent halogen lamps in order to comply with the specifications of regulation 37 of the ECE standard for said categories of lamp.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 2:
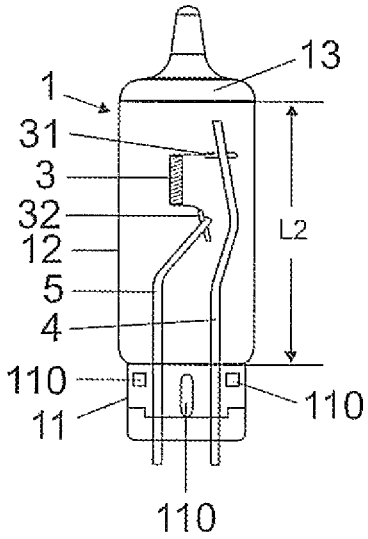
FIG. 2 is a side view of the lamp vessel of the incandescent halogen lamp shown in FIG. 1, without a lamp base

Said incandescent halogen lamp has a translucent lamp vessel 1 which is made of tempered glass, for example alkali-free alkaline earth aluminosilicate glass, and is fixed into position in metal base part 21 of a lamp base 2. Plastic base part 22, adjoining metal base part 21, of lamp base 2 is fitted with the incandescent halogen lamp's electric terminals 6. Lamp vessel 1 having a gas-tight closure has a sealed end 11 which is fixed into position in a holder part 214 of metal base part 21, a hollow, circular-cylindrical central lamp-vessel section 12, and a lamp-vessel dome 13 which is situated opposite sealed end 11 and furnished with a non-translucent coating. Circular-cylindrical lamp-vessel section 12 has an external diameter of 9.5 mm, a wall thickness of 0.9 mm, and an internal diameter of 7.7 mm. Length L2 of circular-cylindrical lamp-vessel section 12 measured in the direction of its cylinder axis, meaning the longitudinal extent of lamp vessel 1 between sealed end 11 and lamp-vessel dome 13, is approximately 14.2 mm. Located in the interior space of lamp vessel 1 is a filling-gas mixture that includes halogens and inert gas, for example krypton or xenon. The pressure of the filling gas measured at 22 degrees Celsius is in the range of 1.5 to 1.8 megapascals. Located inside lamp vessel 1 in the region of circular-cylindrical central lamp-vessel section 12 is a filament 3 embodied as a tungsten coil. Winding axis A of coil 3 is arranged having a parallel offset from cylinder axis of circular-cylindrical lamp-vessel section 12. Each of ends 31, 32 of coil 3 is welded to a supply-lead wire 4, 5 made of molybdenum. Both supply-lead wires 4, 5 are led out of sealed end 11 of lamp vessel 1 and each connected to one of the incandescent halogen lamp's two electric terminals 6. The section, projecting into circular-cylindrical lamp-vessel section 12, of supply-lead wire 4 extends up to a height of approximately 10.5 mm above the lamp vessel's sealed end 11 and so is 29% shorter than in incandescent halogen lamps according to the prior art. The section, projecting into circular-cylindrical lamp-vessel section 12, of the other supply-lead wire 5 extends up to a height of approximately 5.2 mm above sealed end 11 of lamp vessel and so is 37% shorter than in incandescent halogen lamps according to the prior art. Both electric terminals 6 are embodied as metal connecting lugs each of whose first ends is welded to supply-lead wire 4 or 5 and whose second end is accessible via plastic base part 22, embodied like a plug, for connecting the incandescent halogen lamp's supply voltage. Supply-lead wires 4, 5 and connecting lugs 6 are laser-welded via apertures in first metal sleeve 211, as is described in, for example, WO 2007/096330 A1. Sealed end 11 of lamp vessel 1 is embodied as a compressible seal. The surface of sealed end 11 has a plurality of fins or studs 110 (FIG. 2) that interact with metal links of holder part 214 for fixing lamp vessel 1 into position in lamp base 2.

Lamp base 2 consists of a plastic base part 22 that is embodied as a plastic injection-molded part and in which the incandescent halogen lamp's electric terminals 6 are embedded and of a metal base part 21 assembled from a plurality of metal components 211, 212, 213, 214.

Plastic base part 22 has a surface 220 from which a first, hollow-cylindrical metal sleeve 211 projects. Said first hollow-cylindrical metal sleeve 211 has been joined to the plastic base part 22 by means of an injection-molding or high-frequency-fusing process and forms a component of metal base part 21. The lateral surface of first hollow-cylindrical metal sleeve 211 has an aperture projecting through which is a pressure spring 215 having a spring effect in the radial direction of first metal sleeve 211. Bearing upon aforementioned surface 220 of plastic base part 22 is a gasket 23 that is made of silicone and arranged coaxially with respect to first, hollow-cylindrical metal sleeve 211. Gasket 23 is slightly conical in shape, meaning that its internal diameter and external diameter increase from its underside bearing upon surface 220 in the direction of its top side facing reference lugs 213*a*. Gasket 23 is thereby clamped into position in a slot that is formed as neatly accommodating by plastic base part 22. Metal base part 21 furthermore has a second hollow-cylindrical metal sleeve 212 having on its bottom edge facing first metal sleeve 211 an annular collar 213 which has three reference lugs 213*a*. Annular collar 213 is welded to first metal sleeve 211 so that the cylinder axes of the two metal sleeves 211, 212 are arranged either coaxially or having a parallel offset. The three reference lugs 213*a* stand out from the lateral surface of second hollow-cylindrical metal sleeve 212, each extend in the direction of a diameter of second metal sleeve 212, and are disposed equidistantly around the circumference of annular collar 213. The underside, facing gasket 23, of the three reference lugs 213*a* defines a reference plane R oriented substantially perpendicularly to the cylinder axis of metal sleeve 211 and of lamp-vessel section 12 for orienting the incandescent halogen lamp in the vehicle headlight. It corresponds to the reference plane cited in regulation 37 of ECE standard 324. Further belonging to metal base part 21 is aforementioned conically embodied metal holder part 214 serving to hold sealed end 11 of lamp vessel 1. Height B of lamp base 2 above reference plane R is approximately 13.6 mm.

Holder part 214 (FIG. 3) is embodied likewise as a metal sleeve and has a hollow-cylindrical first section 2141 adjoined by a hollow second section 2142 that is embodied conically, particularly in the manner of a truncated cone. The external diameter of hollow-cylindrical first holder-part section 2141 is slightly smaller than the internal diameter of second metal sleeve 212. Hollow-cylindrical first section 2141 of holder part 214 is inserted into second hollow-cylindrical metal sleeve 212 and welded thereto. Second holder-part section 2142 shaped like a truncated cone has on its top side 2140 facing lamp vessel 1 a reduced external diameter which is smaller than the external diameter of hollow-cylindrical first section 2141 of holder part 214.

The external diameter of holder part 214 in the region of hollow-cylindrical first holder-part section 2141 is 15 mm. In the region of second holder-part section 2142, shaped like a truncated cone, the external diameter of holder part 214 on top side 2140 facing the lamp vessel is only 12 mm. The height of conically embodied second holder-part section 2142 is 3.5 mm and the height of hollow-cylindrical first holder-part section 2141 is 6 mm.

Top side 2140 of holder part 214 has an aperture 2143 for accommodating sealed end 11 of lamp vessel 1 and eight spring shackles 2144 clamped on sealed end 11 of lamp vessel 1. Spring shackles 2144 therein interact with the fins or, as the case may be, studs 110 that are located on the surface of sealed end 11 of lamp vessel 1 and serve to stop or guide them. In each case four spring shackles 2144 bear against the two opposite sides of sealed end 11 of lamp vessel 1 so that sealed end 11 is clamped between spring shackles 2144. A detailed description of said clamping is disclosed in WO 96/05610 A1, for example.

Lamp vessel 1 and the metal base part will project into the headlight's interior after the incandescent halogen lamp has been mounted so that the underside, facing away from the lamp vessel, of reference lugs 213*a* bears on the inside of the headlight reflector (not shown) and gasket 23 on the outside of the headlight reflector. That means the headlight reflector's wall is clamped between reference lugs 213*a* and gasket 23. Pressure spring 215 bears resiliently on the edge of the reflector opening, thereby arresting the incandescent halogen lamp in a position perpendicular to the cylinder axis of first metal sleeve 211. Details of that type of arresting are disclosed in WO 97/25733 A1, for example.

Figure 1:
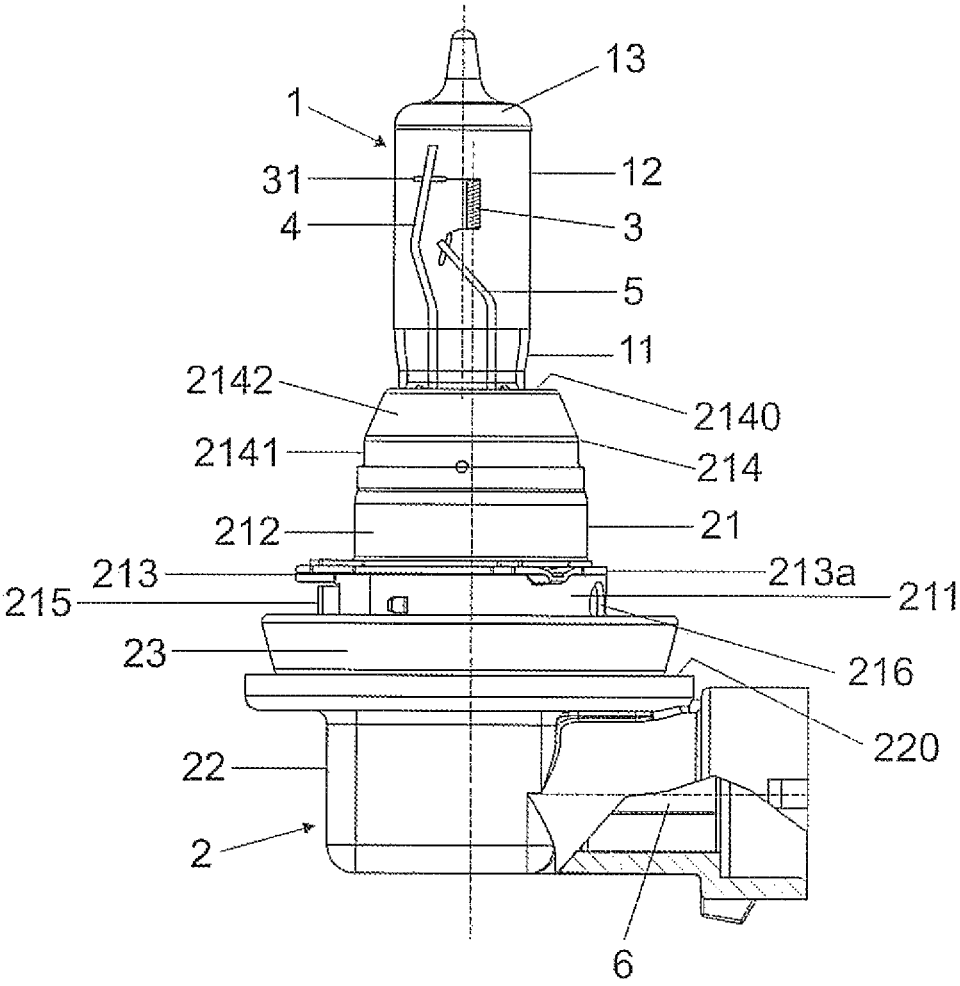
FIG. 1 is a schematic and partially cut side view of an incandescent halogen lamp according to a preferred exemplary embodiment of the invention
Figure 3:
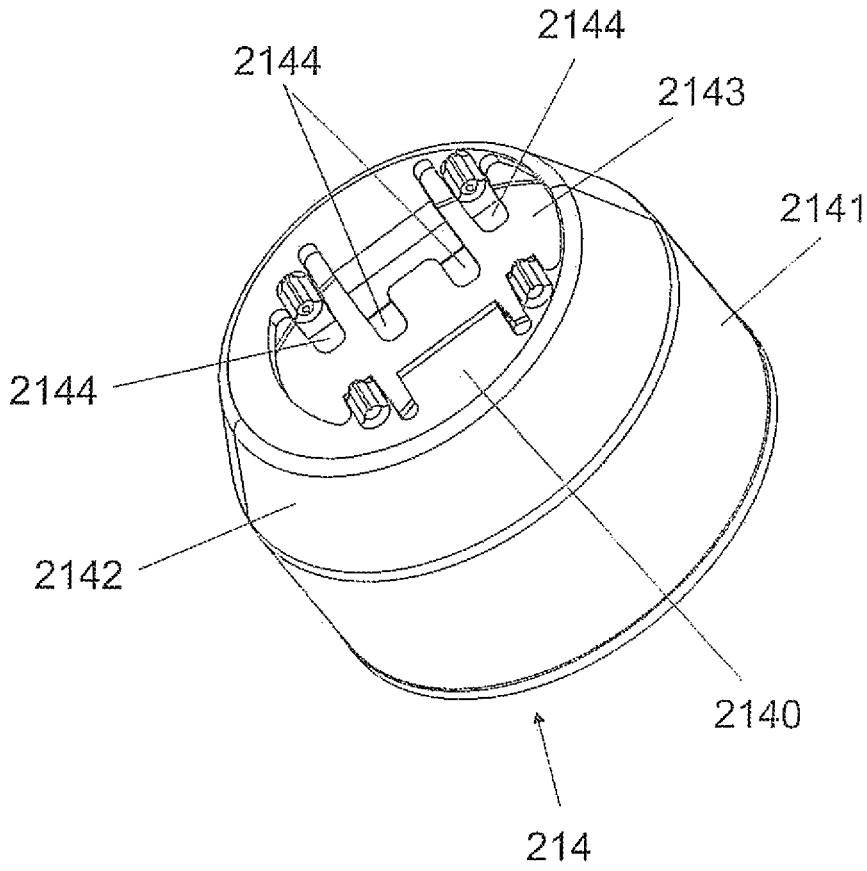
FIG. 3 shows the holder part belonging to the lamp base of the incandescent halogen lamp shown in FIG. 1 according to the first exemplary embodiment of the invention
Figure 4:
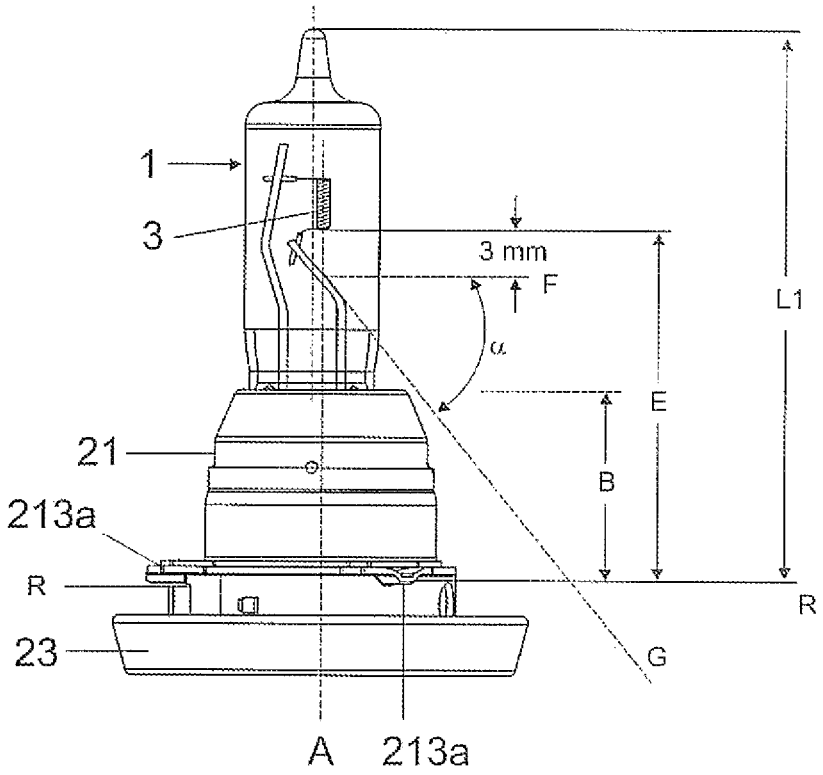
FIG. 4 is a section of the incandescent halogen lamp shown in FIG. 1
Figure 5:
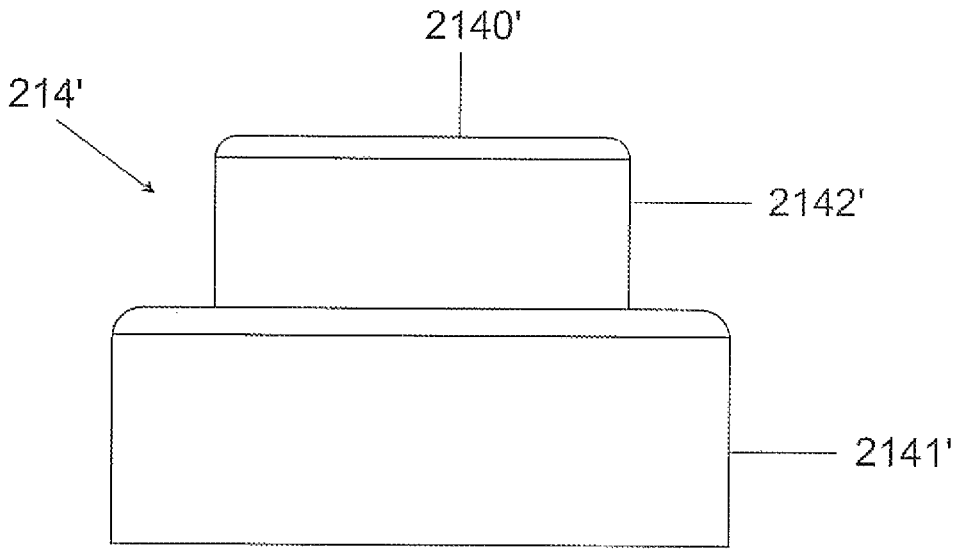
FIG. 5 is a side view of the lamp base's holder part according to the second exemplary embodiment of the invention

According to the second exemplary embodiment of the invention, holder part 214' shown in FIG. 5 is used in the incandescent halogen lamp shown in FIG. 1 instead of holder part 214 shown in FIG. 3. The incandescent halogen lamps according to the first and second exemplary embodiment of the invention concur in all other respects.

Holder part 214' (FIG. 5) is embodied likewise as a metal sleeve and has a hollow-cylindrical first section 2141' adjoined by a hollow-cylindrical second section 2142'. The external diameter of hollow-cylindrical first holder-part section 2141' is slightly smaller than the internal diameter of second metal sleeve 212. Hollow-cylindrical first section 2141' of holder part 214' is inserted into second hollow-cylindrical metal sleeve 212 and welded thereto. Hollow-cylindrical second holder-part section 2142' has a reduced external diameter which is smaller than the external diameter of hollow-cylindrical first section 2141' of holder part 214'.

The external diameter of holder part 214' in the region of hollow-cylindrical first holder-part section 2141' is 15 mm. In the region of hollow-cylindrical second holder-part section 2142' the external diameter of holder part 214' is only 12 mm. The height of second holder-part section 2142' is 3.5 mm and the height of hollow-cylindrical first holder-part section 2141' is 6 mm.

Top side 2140' and the spring shackles of holder part 214' according to the second exemplary embodiment of the invention are embodied in exactly the same way as top part 2140 and spring shackles 2144 of holder part 214 according to the first exemplary embodiment of the invention.

The invention is not limited to the exemplary embodiments described in more detail above. It can in particular be applied also to incandescent halogen lamps belonging to other categories defined by ECE regulation 37.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. An incandescent halogen lamp for vehicle headlights, the incandescent halogen lamp comprising:

a lamp base which defines a reference plane for orienting the incandescent halogen lamp in the vehicle headlight and includes a holder part having a substantially rotationally symmetrical external contour for holding a translucent lamp vessel, with the holder part having a first holder-part section connected to a component of the lamp base and a second holder-part section from which the translucent lamp vessel projects, wherein the second holder-part section has a smaller external diameter than the first holder-part section, wherein the height of the lamp base above the reference plane is in the 11.5-to-16.6 mm range, wherein said translucent lamp vessel has a cylindrical lamp-vessel section that surrounds at least one filament and is closed at one end by a lamp vessel seal out of which electrical supply leads for the at least one filament are led and at the other end by a lamp-vessel dome, and wherein a length of said cylindrical lamp-vessel is less than or equal to 18 mm.

2. The incandescent halogen lamp as claimed in claim 1, wherein the height of the lamp base above the reference plane is in the 12-to-16.6 mm range.

3. The incandescent halogen lamp as claimed in claim 2, wherein the height of the lamp base above the reference plane is in the 13 to 16 mm range.

4. The incandescent halogen lamp as claimed in claim 1, wherein the first holder-part section is embodied as cylindrical and the other holder-part section is embodied in the manner of a truncated cone.

5. The incandescent halogen lamp as claimed in claim 1, wherein the second holder-part section each is embodied as cylindrical or in the manner of a truncated cone.

6. The incandescent halogen lamp as claimed in claim 1, wherein the distance between the at least one filament and the reference plane is in the range of 25.0 mm±0.1 mm.

7. The incandescent halogen lamp as claimed in claim 1, wherein an external diameter of the cylindrical lamp-vessel section is in the 9-to-10-mm range.

8. The incandescent halogen lamp as claimed in claim 1, wherein the lamp vessel is made of tempered glass.

* * * * *